United States Patent [19]

Lee

[11] Patent Number: 4,808,130

[45] Date of Patent: Feb. 28, 1989

[54] SPADE LUG HAVING SCORED SURFACES

[76] Inventor: Noel Lee, 47 W. Park Dr., Daly City, Calif. 94015

[21] Appl. No.: 94,696

[22] Filed: Sep. 9, 1987

[51] Int. Cl.[4] ..... H01R 11/12

[52] U.S. Cl. ..... 439/886; 439/433

[58] Field of Search ..... 439/883, 766, 411, 431, 439/433, 434, 442, 444, 98, 387, 388, 886, 887

[56] References Cited

U.S. PATENT DOCUMENTS 1,697,954 1/1929 Gribbie ..... 439/883

1,847,689 3/1932 Gribbie ..... 439/883

1,874,593 8/1932 Olson ..... 439/883

*Primary Examiner*—Eugene F. Desmond

*Attorney, Agent, or Firm*—Warren B. Kice

[57] ABSTRACT

A connector for providing an electrical connection between an electrical conductor and an electrical terminal. The connector is formed by a body member having a crimpable sleeve for securing the electrical conductor. A slot is formed in the body member for extending around the post of the terminal, and at least one surface of that portion of the body member surrounding the slot is provided with a relatively high frictional surface for engagement with the terminal.

4 Claims, 1 Drawing Sheet

SPADE LUG HAVING SCORED SURFACES

BACKGROUND OF THE INVENTION

This invention relates to an electrical connector and, more particularly, to an electrical connector for providing a electrical connection between a electrical conductor and a electrical terminal.

Many types of connectors have been provided for providing an electrical connection between an electrical conductor and a barrier strip, a terminal block or a single terminal. A spade lug is a popular type since it is easily connected to an electrical conductor, and is shaped so as to extend around a threaded binding post on the barrier strip or terminal so that it can be clamped around the binding post by a nut in threaded engagement with the post. In this manner, the connection can be quickly and easily made and disengaged.

However, these types of connections suffer from the fact that the engaging surfaces of the spade lug, being of a relatively smooth material having a low coefficient of friction, such as gold, brass or brass-plated metal, easily become disengaged from the terminal, thus compromising or destroying the integrity of the electrical connection.

SUMMARY OF THE INVENTION

It is therefore an object of the present invention to provide an electrical connector for providing an improved electrical connection between an electrical conductor and an electrical terminal.

It is a further object of the present invention to provide an electrical connector of the above type in which a relatively high frictional connection is made between the surfaces of the connector and the corresponding surfaces of the electrical terminal to improve the clamping action and integrity of the connection.

Toward the fulfillment of these and other objects, the connector the present invention includes a plate member having means on one end for connection to an electrical conductor. A slot is formed in the other end portion of the body member for extending around the threaded post of an electrical terminal. At least one surface of that portion of the other end portion of the body member that surrounds the slot is treated to provide a relatively high frictional engagement with the corresponding surface of the terminal.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings wherein.

DESCRIPTION OF THE PREFERRED EMBODIMENT

Figure 1:
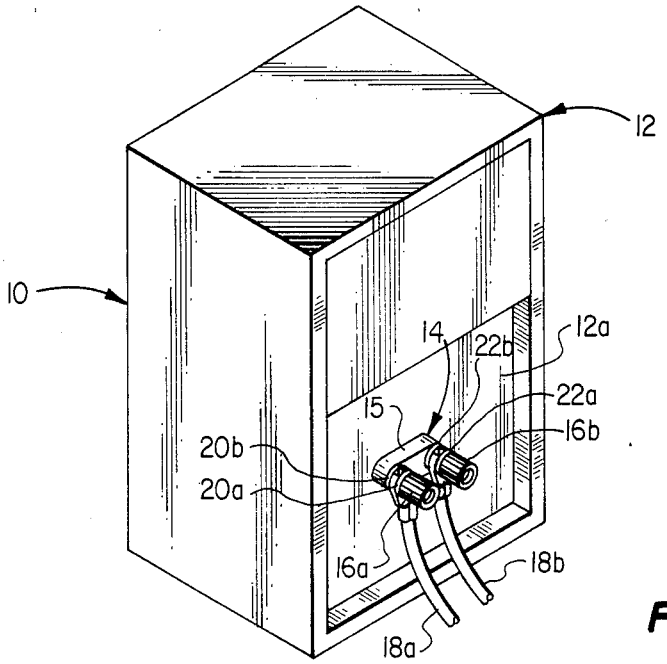
FIG. 1 is rear perspective view of a loudspeaker showing two connectors of the present invention connected thereto.

The connector of the present invention will be described, by example, in connection with an audio loudspeaker referred to, in general, by the reference numeral 10 in FIG. 1 of the drawings. The loudspeaker 10 includes a cabinet, or housing, 12 having a back wall 12*a* on which a electrical terminal assembly 14 is provided. The electrical terminal assembly 14 is of a conventional design and includes a base member 15 and two threaded nuts 16*a* and 16*b* in threaded engagement with a pair of threaded posts, respectively extending from the base member. Normally, a pair of electrical conductors 18*a* and 18*b* are clamped between the nuts 16*a* and 16*b*, respectively, and the base member 15 for connecting an amplifier to the loudspeaker 10.

A pair of washers 20*a* and 20*b* are usually provided between the nut 16*a* and the base member 15, and a pair of washers 22*a* and 22*b* are usually provided between the nut 16*b* and the base member 15. The washers 20*a* and 20*b* provide two spaced flat surfaces between which is clamped the conductor 18*a*, and the washers 22*a* and 22*b* provide two spaced flat surfaces between which is clamped the conductor 18*b*. Normally the end portions of the conductors 18*a* and 18*b* are stripped of insulation and placed between the washers 20 and 20*b* and the washers 22*a* and 22*b*, respectively, to secure the connection.

Figure 2:
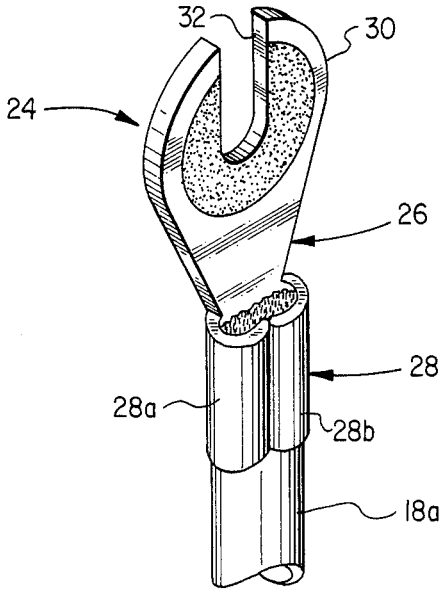
FIG. 2 is a rear perspective view of the connector of the present invention shown connected to an electrical conductor.
Figure 3:
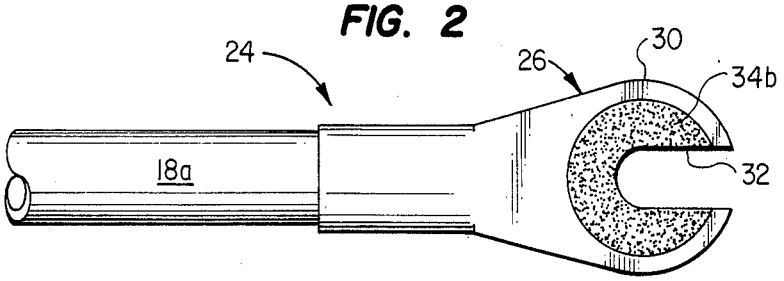
FIG. 3 is a top plan view of the connector and conductor of FIG. 2.

The electrical connector of the present invention is shown by the reference number 24 in FIGS. 2 and 3 and is designed to facilitate the connection between the conductors 18*a* and 18*b* and the terminal assembly 14. The connector 24 is formed by a body member 26 having a crimping sleeve 28 formed integrally therewith by forming two tabs 28*a* and 28*b* which are bent inwardly toward each other. An end portion of the conductor 18*a* or 18*b* is stripped of insulation and placed in the sleeve 28 before the sleeve is crimped over the conductor 18*a*, to secure the connection between the conductor 18*a* and the connector 24 in the manner shown in FIG. 2.

The end portion of the body member 26 opposite that of the sleeve 28 is enlarged to form a head portion 30. A slot 32 is formed in the head portion 30 and is of a size so as to receive either binding post of the terminal assembly 14 on which the nuts 16*a* or 16*b* are threadably engaged.

According to a main feature of the present invention, the opposite surfaces of the head portion 30 are provided with a relative high-friction surface, as shown by the reference numbers 34*a* (FIG. 2) and 34*b* (FIG. 3). The expression "relatively high friction surface" is meant to encompass all surfaces that have a coefficient of friction that is greater than that normally provided by a copper, brass, gold or similar type metal surface. As an example, the body member can be fabricated of a metallic material such as copper, gold, brass, or the like, and the relatively high friction surface can be obtained by scoring, or scratching the surfaces 34*a* and 34*b* in a conventional manner. The surfaces 34*a* and 34*b* substantially correspond in size to the corresponding surfaces of the washers 20*a*, 20*b*, 22*a* and 22*b*.

In this manner, when the conductor 18*a* is attached to the connector 24 in the manner described above, and the head portion 30 is inserted between the nut 16*a* and the base member 15, and, more particularly, between the two washers 20*a* and 20*b*, the relatively high friction surfaces 34*a* and 34*b* are engaged by the washers 20*a* and 20*b* upon advancement of the nut 16*a* towards the base member 15, resulting in a very positive clamping of the connection 24 between the washers. Of course, another connector 24 would be connected to the conductor 18*b* and clamped by the nut 16*b* in the same manner.

The relatively high friction surfaces 34*a* and 34*b* dramatically increase the frictional engagement of the connector 24 with the terminal assembly 14, and provide a superior connection that improves the current carrying capability of the connection while insuring that the connection will not deteriorate with age.

It is understood that several variations may be made in the foregoing without departing from the scope of the invention. For example, the washers 20*a* and 20*b* and the washers 22*a* and 22*b* can be eliminated in which case the connector 24 of the present invention would extend directly between the nuts 16*a* and 16*b* and the corresponding surfaces of the base member 15.

Other modifications, changes and substitutions are intended in the foregoing disclosure and, in some instances, some features of the invention can be employed without a corresponding use of other features. Accordingly, it is appropriate that the appended claims be construed broadly and in a manner consistent with the scope of the invention.

What is claimed is:

1. A connector for providing an electrical connection between an electrical conductor and an electrical terminal having a threaded post, said connector comprising a plate member defining two opposed flat planar surfaces, means provided on said plate member for connecting to an electrical conductor, and a slot formed in said plate member and extending between said two opposed surfaces, the wall of said plate member defining said slot providing a continuous U-shaped surface for extending around said post, the areas of said flat planar surfaces of said plate member being scored to increase their respective coefficients of friction and thereby to provide a relatively high frictional engagement with corresponding planar surfaces of said terminal.

2. The connector of claim 1 wherein said connecting means comprises a sleeve formed integrally with said plate member for crimping over said conductor.

3. The connector of claim 1 wherein said slot is formed in an end portion of said plate member, and wherein said end portion is clamped between a clamping member and a base portion of said terminal with said scored surfaces in engagement with corresponding planar surfaces of said clamping member and said base portion.

4. The connector of claim 3 wherein said opposed surfaces are sized so that said scored surfaces substantially correspond in size to the corresponding surfaces of said clamping member and said base portion.

* * * * *